US009024826B2

(12) United States Patent
Tolbert et al.

(10) Patent No.: US 9,024,826 B2
(45) Date of Patent: May 5, 2015

(54) ELECTRONIC DEVICES WITH ANTENNAS FORMED WITH OPTICALLY-TRANSPARENT FILMS AND RELATED METHODS

(71) Applicant: HTC Corporation, Taoyuan, Taoyuan County (TW)

(72) Inventors: William Haywood Tolbert, Chapel Hill, NC (US); Rodney Owen Williams, Cary, NC (US); Gregory A. Dunko, Cary, NC (US); Tae Young Yang, Cary, NC (US); Jason Donald Mareno, Raleigh, NC (US)

(73) Assignee: HTC Corporation, Taoyuan, Taoyuan County (TW)

( * ) Notice: Subject to any disclaimer, the term of this patent is extended or adjusted under 35 U.S.C. 154(b) by 272 days.

(21) Appl. No.: 13/775,738

(22) Filed: Feb. 25, 2013

(65) Prior Publication Data

US 2014/0240176 A1 Aug. 28, 2014

(51) Int. Cl.

| | |
|---|---|
| ***H01Q 1/24*** | (2006.01) |
| ***H01Q 1/52*** | (2006.01) |
| ***H01Q 13/10*** | (2006.01) |

(52) U.S. Cl.
CPC ..... *H01Q 1/243* (2013.01); *H01Q 1/52* (2013.01); *H01Q 13/106* (2013.01)

(58) Field of Classification Search
CPC ..... H01Q 13/106; H01Q 1/243
USPC ..... 343/702, 767, 770, 789
See application file for complete search history.

(56) References Cited

U.S. PATENT DOCUMENTS

| | | | | |
|---|---|---|---|---|
| 5,532,705 | A * | 7/1996 | Hama | 343/718 |
| 8,489,162 | B1 * | 7/2013 | Dou et al. | 455/575.7 |
| 2011/0273351 | A1 * | 11/2011 | Johnson | 343/770 |

* cited by examiner

*Primary Examiner* — Tho G Phan
(74) *Attorney, Agent, or Firm* — McClure, Qualey & Rodack, LLP

(57) ABSTRACT

Electronic devices with antennas formed with optically-transparent films and related methods are provided. In this regard, a representative device includes a housing defining a cavity; a display disposed within the cavity; a cover disposed over the display and forming a portion of an exterior of the device; an optically transparent, electrically conductive film disposed within the cavity; and an antenna disposed within the cavity, the antenna being at least partially defined by the film, the film being operative as a ground plane for the antenna.

25 Claims, 4 Drawing Sheets

ELECTRONIC DEVICES WITH ANTENNAS FORMED WITH OPTICALLY-TRANSPARENT FILMS AND RELATED METHODS

TECHNICAL FIELD

The present disclosure generally relates to mobile devices.

BACKGROUND

Presently, mobile devices (e.g., smartphones) with small form factors and metallic uni-body designs are favored by users. Unfortunately, a small form factor places rather significant limitations on various aspects of product design, such as antenna placement, volume and performance. Notably, either antenna radiation efficiency or operational bandwidth performance is typically sacrificed when antenna placement volume is reduced in a small form factor device. In this regard, a conventional design solution for antenna placement involves forming small size radio frequency (RF) apertures that are typically filled with plastic in a metallic uni-body.

SUMMARY

Electronic devices with antennas formed with optically-transparent films and related methods are provided. Briefly described, one embodiment, among others, is an electronic device comprising: a housing defining a cavity; a display disposed within the cavity; a cover disposed over the display and forming a portion of an exterior of the device; an optically transparent, electrically conductive film disposed within the cavity; and an antenna disposed within the cavity, the antenna being at least partially defined by the film, the film being operative as a ground plane for the antenna.

Another embodiment is a method comprising: providing a device housing; and disposing an optically transparent, electrically conductive film within a cavity of the housing to define a slot antenna.

Other systems, methods, features, and advantages of the present disclosure will be or may become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure may be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
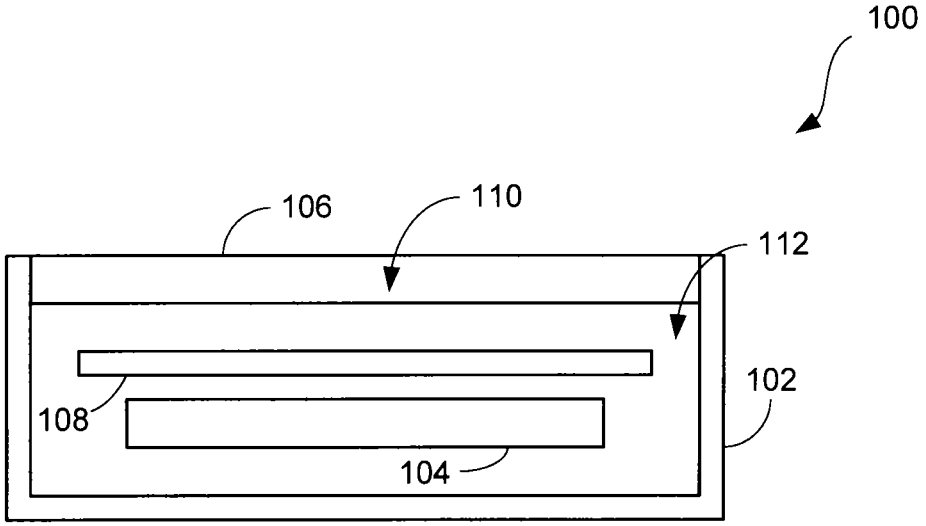
FIG. 1 is a schematic diagram of an example embodiment of an electronic device.

Having summarized various aspects of the present disclosure, reference will now be made in detail to that which is illustrated in the drawings. While the disclosure will be described in connection with these drawings, there is no intent to limit the scope of legal protection to the embodiment or embodiments disclosed herein. Rather, the intent is to cover all alternatives, modifications and equivalents included within the spirit and scope of the disclosure as defined by the appended claims.

In this regard, electronic devices with antennas formed with optically transparent films and related methods are provided. In some embodiments, an optically transparent, electrically conductive film is positioned between a cover and a display of the device. One or more slot antennas are defined between the film and the housing, with the film functioning as the ground plane. As such, an antenna (e.g., a Bluetooth, WiFi, GPS, or NFC antenna) may be provided without the necessity of forming apertures through the housing.

FIG. 1 is a schematic diagram of an example embodiment of an electronic device. As shown in FIG. 1, device 100 (which may be provided in various forms such as a tablet computer and a smartphone, among others) includes a housing 102, a display module 104, a cover 106 and an optically transparent, electrically conductive film 108. The housing, which is composed of either RF-transparent material (e.g. plastic) or non-RF-transparent material (e.g., metal), defines a cavity 110 in which the display and the film are disposed. The cover is disposed over the display and forms a portion of an exterior of the device.

An antenna 112 also is disposed within the cavity. In this embodiment, the antenna is a slot antenna, with portions of the antenna being defined by the film and the housing. Of note, the film functions as a ground plane for the antenna. In some embodiments, the film may be provided as a separate component. In other embodiments, the film may be provided as a constituent of another component, such as a ground layer (shielding) for a touch input sensor. In other embodiments, the film may be integrated in an On-Cell-Touch or an In-Cell-Touch display element, for example.

Because the actual radiation from the antenna propagates from the edge of the transparent film (and a corresponding portion of the housing), the antenna is potentially more efficient than an antenna disposed directly on top of the display. Additionally, since the antenna is disposed beneath the cover, inherent protection against gross mistuning from user contact is provided.

Although various types and configurations of films may be used, one suitable film is an Indium Tin Oxide (ITO) film that incorporates an optically transparent conductive pattern, such as a printed metal pattern.

Figure 2:
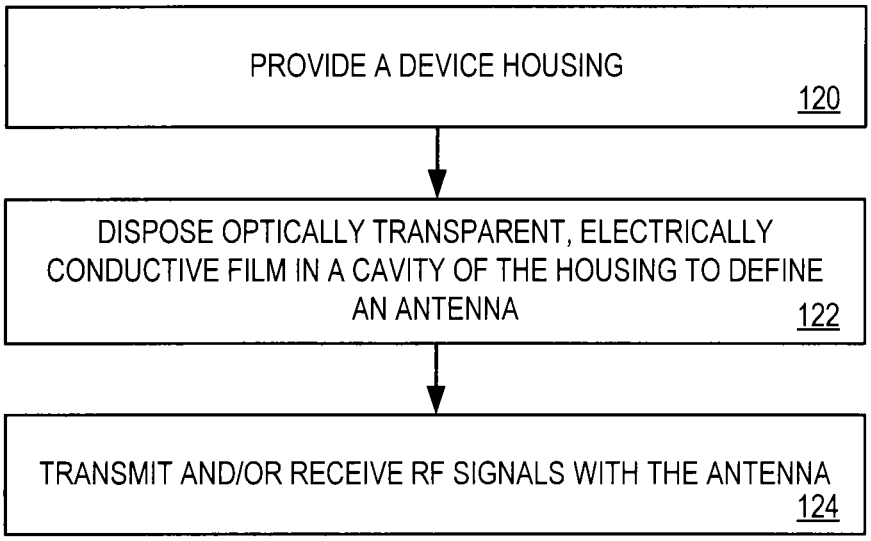
FIG. 2 is a flowchart depicting an example embodiment of a method for forming an electronic device.

FIG. 2 is a flowchart depicting an example embodiment of a method for forming an electronic device. As shown in FIG. 2, the method may be construed as beginning at block 120, in which a device housing is provided. In block 122, an optically transparent, electrically conductive film is disposed within a cavity of the housing to define a slot antenna. In some embodiments, the film and housing define multiple antennas of an electronic device. Thereafter, such as depicted in block 124, the antenna is used by the device to transmit and/or receive RF signals.

Figure 3:
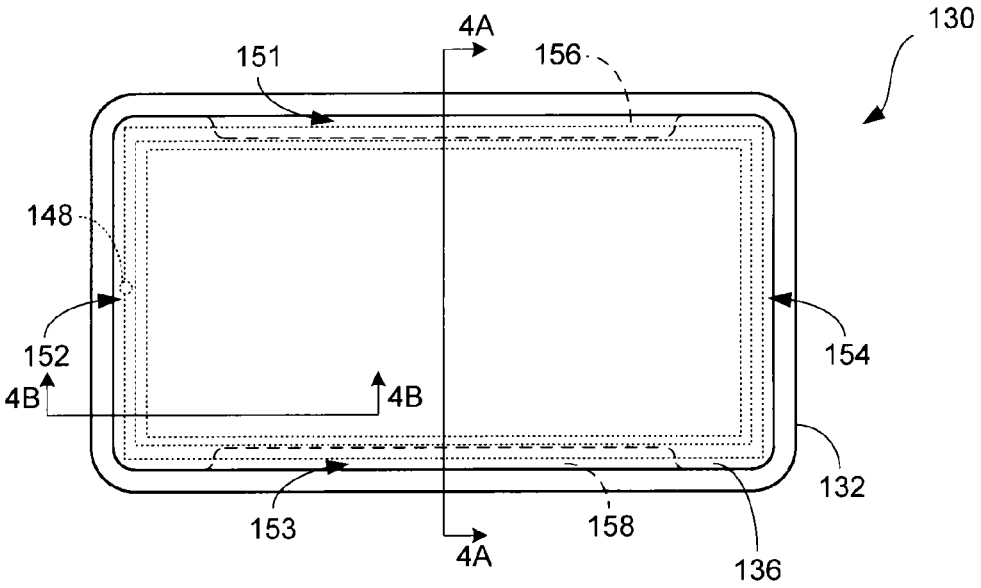
FIG. 3 is a schematic diagram of another example embodiment of an electronic device.
Figure 4A:
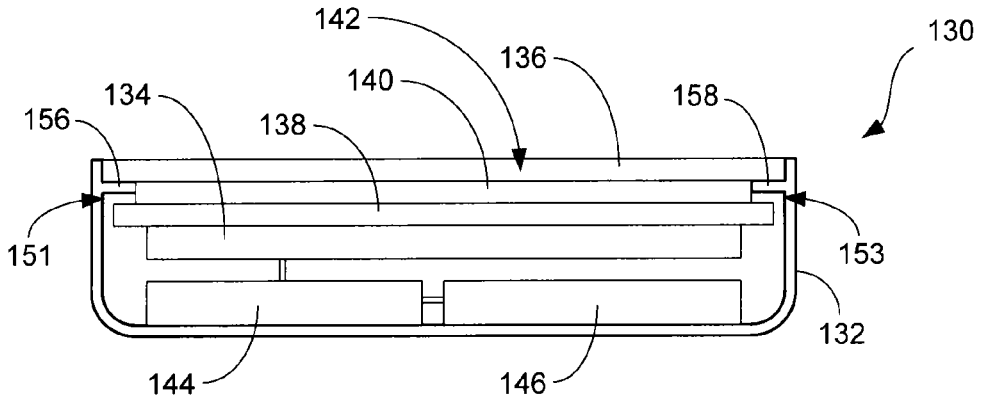
FIG. 4A is a representative cross-section along line 4A-4A of FIG. 3.
Figure 4B:
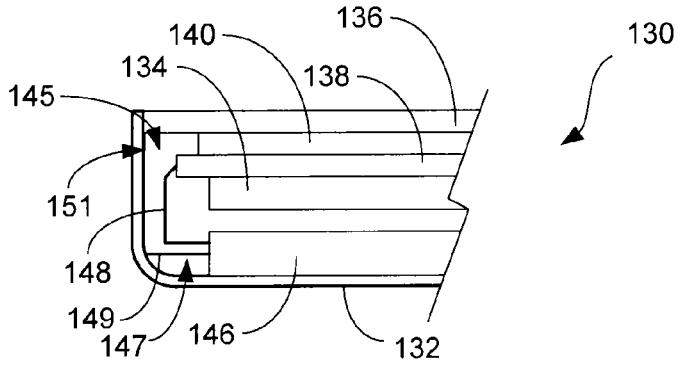
FIG. 4B is a representative cross-section along line 4B-4B of FIG. 3.

FIGS. 3, 4A and 4B are schematic diagrams of another example embodiment of an electronic device. With reference to FIGS. 3, 4A and 4B, device 130 includes a housing 132, a display module 134 (e.g., an LCD module), a cover 136, an optically transparent film 138 and a touch input device 140. Specifically, the film is disposed between the display and the touch input device—the touch input device being disposed between the film and the cover.

The housing defines a cavity 142 in which various components of the device are disposed, such as the display, the film and the touch input sensor, as well as a system board 144, a battery 146 and an antenna feed 148 (other components are omitted for ease of description). The cover, which is supported by support structure of the housing, is disposed over the cavity and forms a portion of an exterior of the device.

Four slits (151, 152, 153 and 154) are defined between the housing and the film: two long slits (151, 153) and two short slits (152, 154). Slits 151, 153 are partially covered with the portion of the housing acting as a supporting structure for the display module and the touch input device. In this embodiment, the support structure includes ledges 156 and 158 that extend inwardly from interior sidewalls of the housing. The cover seats on the ledges.

Slits 152, 154 form an antenna array and are used as radiating slot antennas, with portions of the antennas being defined by corresponding portions of the film and the housing. The film functions as a ground plane for the antennas. Additionally, the support structure functions as capacitive loading for the antennas, thereby facilitating miniaturization of antenna size and tuning. Notably, the length and area of the support structure that is in an overlying relationship with a corresponding portion of the film directly relates to frequency tuning of the associated antenna. In this embodiment, only one of the slits is excited with a voltage gap source 145 via a feed 147, but both may be excited in other embodiments.

In operation, a signal line 148 of the feed may be connected to the electrically conductive pattern of the film. A ground 149 of the feed may be connected to the housing if the housing is made out of a conductive material (e.g. metal), thereby creating a potential difference (voltage difference) between the feed 148 and the housing. This provides a voltage source to excite the antenna. If the housing is made out of a non-conductive material (e.g. plastic), the voltage different between the electrically conductive pattern of the film and the system ground may be the source for the slot antenna.

The radiation pattern of the antenna array may be shaped by varying the electrical length between the antennas, such as by altering the electrical distance between two radiating slots or continuous edge contours. For instance, if the antennas are in phase, the resulting radiation pattern would typically cover a hemi-spherical volume above the cover. Notably, this configuration may be preferred for angular coverage of GPS antennas. If, however, the antennas are not in phase, the resulting radiation pattern may be omni-directional in azimuth, such as may be preferred for WLAN applications.

In order to change the electrical length between the antennas, the physical length of the non-radiating edges of the film may be increased. In some embodiments, this may be accomplished by using a meandered shape for the non-radiating edges, resulting in an effective electrical length change. In such condition, the antenna can operate at 13.56 MHz being as the NFC (Near-Field-Communication) antenna to communicate with other electronic equipment or handheld devices. Alternatively, a passive or an active impedance tuning component may be placed between non-radiating edges of the film and signal ground points for antenna impedance tuning and/or a phase shifting.

In some embodiments, a film may be used to provide a near-field proximity sensor, such as may be useful in determining when a device is in close proximity to a user. For instance, such a sensor may be used to determine when a mobile device (e.g., a smartphone) has been placed close to the face of a user during answering of a phone call. As is known, the proximity of a user may impact antenna performance. An embodiment of a device that incorporates such a sensor is described with respect to FIG. 5.

Figure 5:
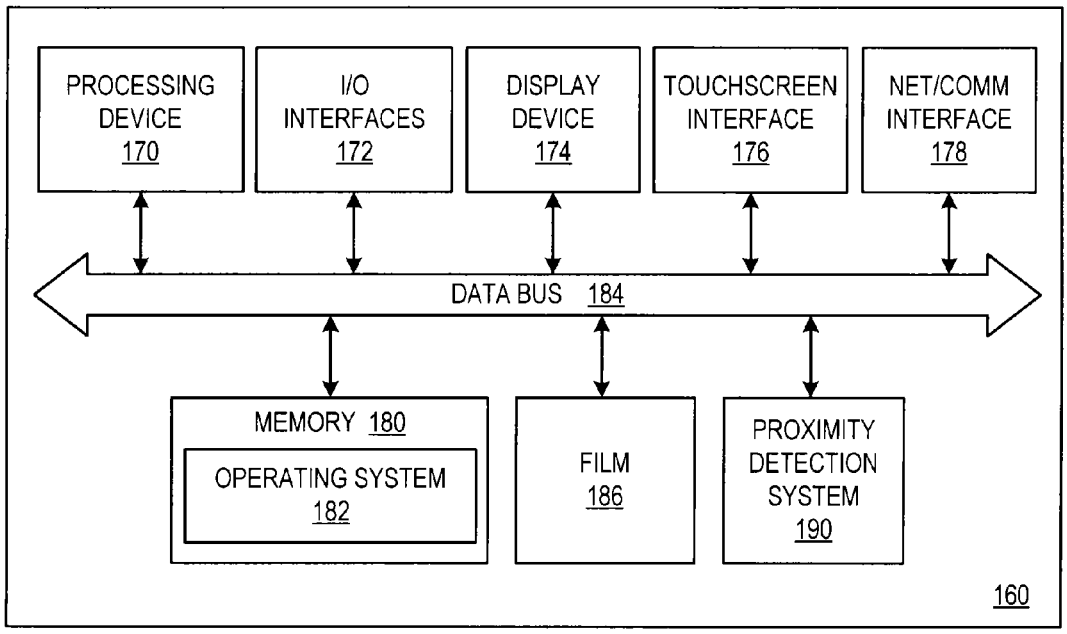
FIG. 5 is a schematic diagram of another example embodiment of an electronic device.

As shown in FIG. 5, electronic device 160 includes a processing device (processor) 170, input/output interfaces 172, a display device 174, a touchscreen interface 176, a network/communication interface 178, a memory 180, and an operating system 182, with each communicating across a local data bus 184. Additionally, the system incorporates an optically transparent, electrically conductive film 186 and a proximity detection system 190.

The processing device 170 may include a custom made or commercially available processor, a central processing unit (CPU) or an auxiliary processor among several processors, a semiconductor based microprocessor (in the form of a microchip), one or more application specific integrated circuits (ASICs), a plurality of suitably configured digital logic gates, and other electrical configurations comprising discrete elements both individually and in various combinations to coordinate the overall operation of the system.

The memory 180 may include any or a combination of volatile memory elements (e.g., random-access memory (RAM, such as DRAM, and SRAM, etc.)) and nonvolatile memory elements. The memory typically comprises native operating system 182, one or more native applications, emulation systems, or emulated applications for any of a variety of operating systems and/or emulated hardware platforms, emulated operating systems, etc. For example, the applications may include application specific software which may comprise some or all the components of the system. In accordance with such embodiments, the components are stored in memory and executed by the processing device.

Touchscreen interface 176 is configured to detect contact within the display area of the display 174 and provides such functionality as on-screen buttons, menus, keyboards, soft keys, etc. that allows users to navigate user interfaces by touch.

One of ordinary skill in the art will appreciate that the memory may, and typically will, comprise other components which have been omitted for purposes of brevity. Note that in the context of this disclosure, a non-transitory computer-readable medium stores one or more programs for use by or in connection with an instruction execution system, apparatus, or device.

With further reference to FIG. 5, network/communication interface 178 may comprise various components used to transmit and/or receive data over a networked environment. By way of example, such components may include a wireless communications interface. When such components are embodied as an application, the one or more components may be stored on a non-transitory computer-readable medium and executed by the processing device.

Film 186, which may be a separate layer or a constituent layer of another component, provides electrical inputs to proximity detection system 190 for operating as a near-field proximity sensor. Notably, in order for the film to provide such inputs, switching the film from an antenna mode to a sensor mode is performed. Specifically, in contrast to being connected to transceiver components during operation in the antenna mode, the film is selectively connected to the proximity detection system.

In operation, the proximity detection system monitors one or more of various parameters, such as antenna impedance, power ratio and reflected power, for example, in order to determine whether the antenna is being influenced by a proximity effect.

Figure 6:
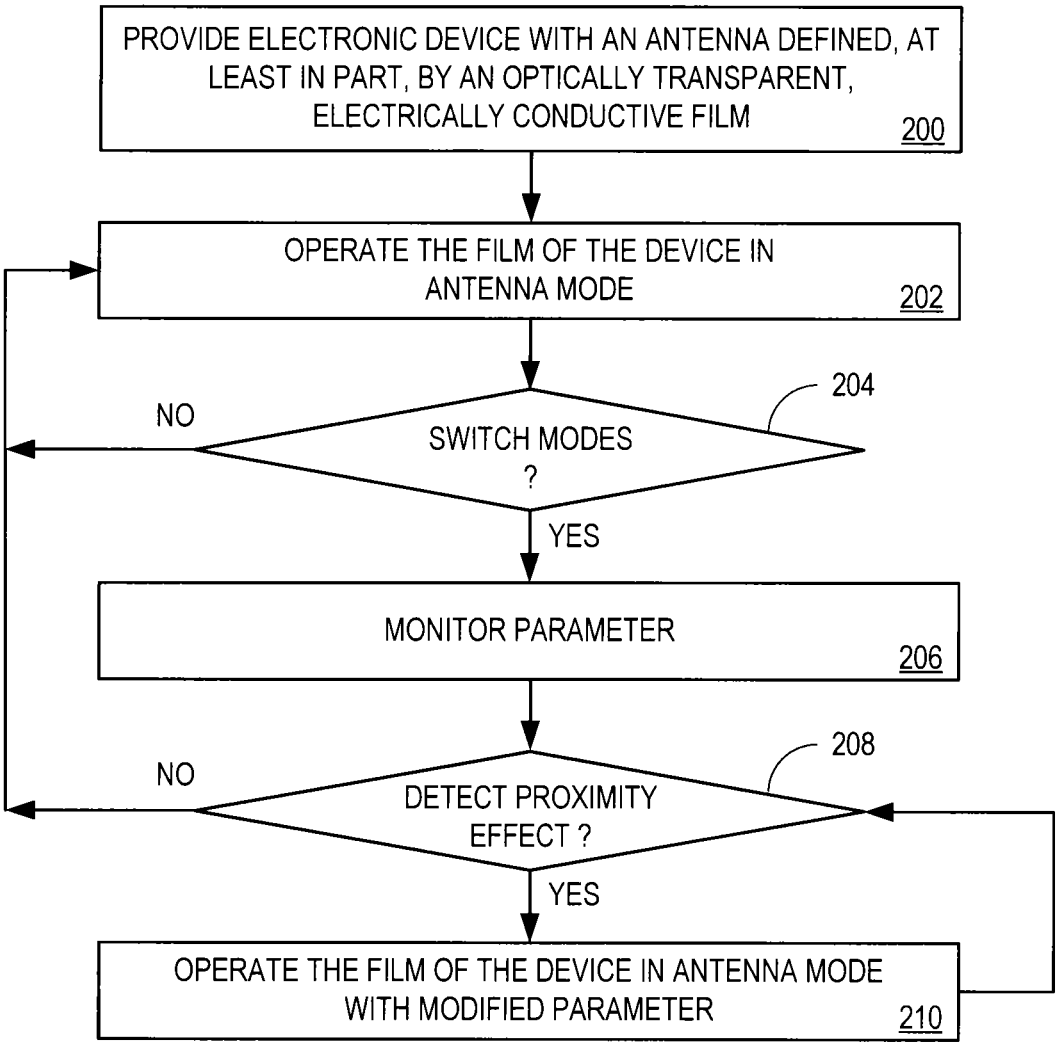
FIG. 6 is a flowchart depicting an example embodiment of a method of operating an electronic device.

FIG. 6 is a flowchart depicting functionality that may be performed by an example embodiment of an electronic device that uses a film for implementing a proximity sensor, such as the embodiment of FIG. 5. As shown in FIG. 6, the functionality (or method) may be construed as beginning at block 200, in which an electronic device is provided. Specifically, the device incorporates an optically transparent, electrically conductive film that is used to define an antenna of the device. In block 202, the film of the device is operated in an antenna mode, in which the antenna is used to transmit and/or receive RF signals. Then, as depicted in block 204, a determination is made as to whether the device is to switch modes of operation. In particular, the determination involves whether the film is to operate in the antenna mode or in a sensor mode.

If it is determined in block 204 that the device is to be operated in the sensor mode, the process proceeds to block 206, in which one or more parameters are monitored. By way of example, antenna impedance, power ratio and/or reflected power may be monitored. In block 208, a determination is made as to whether a proximity effect is detected. If such an effect is detected, such as may be associated with a body part of the user being adjacent the antenna of the device, the process may proceed to block 210. In block 210, the film is once again operated in the antenna mode; however, operation is performed with a modified parameter in order to mitigate degraded antenna performance attributable to the sensed proximity. Then, the process may return to block 208. If, however, the determinations are negative in blocks 204 and 208, the process may return to block 202.

If embodied in software, it should be noted that each block depicted in the flowchart of FIG. 6 (or any of the other flowcharts) represents a module, segment, or portion of code that comprises program instructions stored on a non-transitory computer readable medium to implement the specified logical function(s). In this regard, the program instructions may be embodied in the form of source code that comprises statements written in a programming language or machine code that comprises numerical instructions recognizable by a suitable execution system. The machine code may be converted from the source code, etc. If embodied in hardware, each block may represent a circuit or a number of interconnected circuits to implement the specified logical function(s). Additionally, although the flowcharts show specific orders of execution, it is to be understood that the orders of execution may differ.

It should be emphasized that the above-described embodiments are merely examples of possible implementations. Many variations and modifications may be made to the above-described embodiments without departing from the principles of the present disclosure. By way of example, the systems described may be implemented in hardware, software or combinations thereof. All such modifications and variations are intended to be included herein within the scope of this disclosure and protected by the following claims.

At least the following is claimed:

1. An electronic device comprising:
a housing defining a cavity;
a display disposed within the cavity;
a cover disposed over the display and forming a portion of an exterior of the device;
an optically transparent, electrically conductive film disposed within the cavity;
an antenna disposed within the cavity, the antenna being at least partially defined by the film, the film being operative as a ground plane for the antenna; and
a support structure extending into the cavity from the housing, the cover being supported by the support structure, wherein the support structure capacitively loads the antenna.

2. The device of claim 1, wherein the antenna is a slot antenna further defined by a portion of the housing.

3. The device of claim 2, wherein:
the antenna is a first antenna; and
the device further comprises a second antenna, the second antenna being defined, at least in part, by the housing and the film.

4. The device of claim 3, wherein the first antenna and the second antenna are separated with a distance to be electrically in phase for directional angular coverage.

5. The device of claim 3, wherein the first antenna and the second antenna are separated with a distance to be electrically not in phase for omni-directional angular coverage.

6. The device of claim 1, wherein:
the device further comprises a touch input sensor disposed between the display and the cover; and
the film is disposed between the display and the touch input sensor.

7. The device of claim 6, wherein the film is operative as a ground layer for the touch input sensor.

8. The device of claim 6, wherein the film is capacitively coupled to the touch input sensor.

9. The device of claim 1, wherein:
the device further comprises a touch input sensor disposed between the display and the cover; and
the film is a ground layer of the touch input sensor.

10. The device of claim 1, wherein the housing is a unibody housing.

11. The device of claim 1, wherein:
the system further comprises a proximity detection system electrically communicating with the film; and
the film is operative to provide electrical inputs to the proximity detection system for operating as a near-field proximity sensor.

12. The device of claim 11, wherein the proximity detection system is operative to analyze reflected power associated with the antenna.

13. The device of claim 1, wherein the device is configured as a portable wireless device allowing user input interactions between the user and the device.

14. The device of claim 1, wherein:
the antenna is configured as either a Bluetooth, WiFi, GPS, or NFC antenna;
the antenna is associated with an electrical distance between two radiating slots or continuous edge contours.

15. The device of claim 1, further comprising an antenna feed having a signal line electrically connected to the conductive film.

16. The device of claim 15, wherein:
the film has opposing short edges and opposing long edges;
the signal line is electrically connected to a first of the short edges; and
a first of the long edges corresponds to the antenna.

17. The device of claim 1, wherein:
the housing is made from the conductive material; and
the antenna feed has a ground line electrically connected to the housing.

18. The device of claim 1, wherein:
the housing is made from the non-conductive material; and the antenna feed has a ground line electrically connected to the ground plane.

19. A method for forming an electronic device comprising:

providing a device housing and a display positioned at least partially within a cavity defined by the housing;

disposing an optically transparent, electrically conductive film within the cavity of the housing to define a slot antenna; and capacitively loading the antenna using a support structure extending into the cavity from the housing, the support structure supporting a cover disposed over the display and forming a portion of an exterior of the device.

20. The method of claim 19, further comprising operating the film in an antenna mode such that the antenna is used to transmit and/or receive RF signals.

21. The method of claim 19, further comprising operating the film in a sensor mode such that the antenna is used to determine presence of a proximity effect.

22. The method of claim 19, further comprising selectively operating the film in an antenna mode, in which the antenna is used to transmit and/or receive RF signals, and a sensor mode, in which the antenna is used to determine presence of a proximity effect.

23. An electronic device comprising:

a housing defining a cavity;

a display disposed within the cavity;

a cover disposed over the display and forming a portion of an exterior of the device;

an optically transparent, electrically conductive film disposed within the cavity; an antenna disposed within the cavity, the antenna being at least partially defined by the film, the film being operative as a ground plane for the antenna; and a proximity detection system electrically communicating with the film, the film being operative to provide electrical inputs to the proximity detection system for operating as a near-field proximity sensor.

24. The device of claim 23, wherein the proximity detection system is operative to analyze reflected power associated with the antenna.

25. An electronic device comprising:

a housing defining a cavity;

a display disposed within the cavity;

a cover disposed over the display and forming a portion of an exterior of the device;

an optically transparent, electrically conductive film disposed within the cavity, the film having opposing short edges and opposing long edges;

an antenna disposed within the cavity, a first of the long edges of the film corresponding to the antenna such that the antenna is at least partially defined by the film, the film being operative as a ground plane for the antenna; and an antenna feed having a signal line electrically connected to the conductive film, the signal line being electrically connected to a first of the short edges.

* * * * *